US008029341B2

(12) United States Patent
Belly et al.

(10) Patent No.: US 8,029,341 B2
(45) Date of Patent: Oct. 4, 2011

(54) POLISHING TOOL COMPRISING A DRIVE PLATE AND A REMOVABLE PAD FOR FINISHING AN OPHTHALMIC LENS

(75) Inventors: Jean-Francois Belly, Charenton le Pont (FR); Laurent Chabin, Dallas, TX (US)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 1154 days.

(21) Appl. No.: 11/662,075

(22) PCT Filed: Sep. 1, 2005

(86) PCT No.: PCT/FR2005/002182

§ 371 (c)(1),
(2), (4) Date: Jun. 6, 2007

(87) PCT Pub. No.: WO2006/030091

PCT Pub. Date: Mar. 23, 2006

(65) Prior Publication Data

US 2008/0096478 A1 Apr. 24, 2008

(30) Foreign Application Priority Data

Sep. 10, 2004 (FR) ..... 04 09636

(51) Int. Cl.
*B24B 41/00* (2006.01)

(52) U.S. Cl. ..... 451/360; 451/259; 451/290; 451/508

(58) Field of Classification Search ..... 451/41, 451/42, 259, 260, 278, 285, 290, 344, 359, 451/360, 508, 509, 287, 921

See application file for complete search history.

(56) References Cited

U.S. PATENT DOCUMENTS

| | | | | |
|---|---|---|---|---|
| 5,931,724 | A | 8/1999 | Perlov et al. | |
| 5,967,886 | A | 10/1999 | Wuensch et al. | |
| 6,302,617 | B1 * | 10/2001 | Rumpp | 403/348 |
| 6,336,849 | B1 * | 1/2002 | Konnemann | 451/259 |
| 7,147,550 | B2 * | 12/2006 | Chen | 451/520 |
| 7,217,176 | B2 * | 5/2007 | Schneider et al. | 451/283 |
| 7,278,908 | B2 * | 10/2007 | Urban et al. | 451/285 |
| 7,465,222 | B1 * | 12/2008 | Sun et al. | 451/342 |
| 7,578,730 | B2 * | 8/2009 | Chen | 451/466 |
| 7,621,801 | B2 * | 11/2009 | Himmelsbach | 451/342 |
| 7,625,265 | B2 * | 12/2009 | Woods et al. | 451/451 |
| 2001/0041650 | A1 | 11/2001 | Senga et al. | |
| 2002/0119740 | A1 * | 8/2002 | Puzio et al. | 451/350 |

FOREIGN PATENT DOCUMENTS

DE 44 44 496 6/1996

(Continued)

*Primary Examiner* — Eileen P. Morgan
(74) *Attorney, Agent, or Firm* — Young & Thompson

(57) ABSTRACT

A polishing tool (1) for finishing an ophthalmic lens includes a drive plate (4) which is equipped with elements (2) for mounting same to the spindle of a polishing machine; a removable polishing pad (5) designed to be rotated by the drive plate (4); positioning elements to block the radial movement of the pad (5) in relation to the plate (4) as well as to enable the pad (5) to slide axially in relation the plate (4); retaining elements which limit the axial sliding movement of the pad (5) in relation to the plate (4) to a pre-determined sliding range; and elements for stopping the rotational movement, having at least one tooth which can be engaged in a slot having a corresponding shape, one of the elements being provided on the plate (4) and the other on the pad (5).

20 Claims, 5 Drawing Sheets

FOREIGN PATENT DOCUMENTS

| | | |
|---|---|---|
| EP | 0 512 373 | 11/1992 |
| EP | 0 990 402 | 4/2000 |
| WO | WO 01/36157 | 5/2001 |
| WO | WO 01/96067 | 12/2001 |

* cited by examiner

POLISHING TOOL COMPRISING A DRIVE PLATE AND A REMOVABLE PAD FOR FINISHING AN OPHTHALMIC LENS

The invention relates to the field of polishing ophthalmic lenses.

It concerns more particularly a rotary polishing tool for such a lens, that tool being adapted to be mounted on the spindle of a polishing machine.

The fabrication of an ophthalmic lens necessitates in certain cases having recourse to a polishing operation during which an abrasive disk driven in rotation is held against the surface of the lens and sweeps that surface, the lens being itself driven in rotation. It is consequently necessary to provide steps during which this abrasive disk is replaced by a new disk or by a disk with a different grit.

There are known polishing tools or the like adapted to facilitate the replacement of an abrasive disk without having to demount the tool from the spindle of the polishing machine.

The document US 2001/0041650 describes a polishing head attached to an abrasive disk by means of lateral spring blades fixed to the polishing head and engaging in a groove formed on the perimeter of the abrasive disk.

The document DE 44 44 496 describes a rotary tool including a drive plate that drives a member in rotation thanks to a cruciform projection inserted in a complementary recess of the member. The member is held against the drive plate by magnets.

Moreover, the document WO 01/36157 describes a cutting tool the cutting member whereof is held between two attachment members held one against the other by means of an elastic ring that is fastened to one of the attachment members and is held against a shoulder provided on the other attachment member.

The document U.S. Pat. No. 5,931,724 describes a polishing tool including a drive plate adapted to drive an abrasive disk in rotation by means of three pegs projecting from the drive plate that are inserted in three complementary orifices of the abrasive disk and by means of three pivoting locking members adapted to hold the abrasive disk against the drive member.

Moreover, the document WO 01/96067 describes a polishing tool including a drive plate on which an abrasive disk is removably mounted by means of elastic lugs.

The object of the invention is to improve this type of polishing tool that includes a drive plate on which an abrasive disk may be removably mounted.

To this end, the invention is directed to a polishing tool for finishing an ophthalmic lens, including:

- a drive plate equipped with means for mounting it on the spindle of a polishing machine;
- a removable polishing pad adapted to be driven in rotation by the drive plate;
- characterized in that it further includes
- positioning means for radially immobilizing said pad with respect to said plate and enabling axial sliding of the pad with respect to the plate;
- retaining means limiting the axial sliding of the pad with respect to the plate to a pre-determined sliding range;
- rotational locking means including at least one tooth adapted to engage in a slot of corresponding shape, the tooth and the slot being disposed one on the plate and the other on the pad.

Such a polishing tool enables decoupling of the positioning of the polishing pad and its driving in rotation.

The mounting of the polishing pad is facilitated by the fact that the intervention of the user is limited to the engagement of the polishing pad in the retaining means.

In fact the force exerted by the spindle of the polishing machine on the ophthalmic lens is exploited to lock the polishing pad rotationally thanks to the rotational locking means.

On engagement of the polishing pad in the retaining means, the polishing pad slides freely the length of the predetermined sliding range and it is only when the polishing pad bears on the ophthalmic lens and the rotation of the spindle is started that the tooth engages in the slot, at the moment when the tooth and the slot are placed face-to-face at the end of a relative rotation of the drive plate with respect to the polishing pad.

The user is relieved of having to orient the pad angularly relative to the plate because the engagement of the tooth in the slot is effected automatically.

The polishing tool according to the invention may further have the following features, separately or in combination:

- the positioning means include a groove in which an elastic fixing lug engages, the groove and the fixing lug being disposed one on the plate and the other on the pad;
- the groove is circular and the fixing lugs are disposed in a circle so as to define a cylinder adapted to engage in the groove;
- the retaining means include a flange disposed in the groove and a boss disposed on the fixing lug;
- the rotational locking means include a plurality of slots disposed in a circle and distributed regularly;
- the rotational locking means include a plurality of teeth disposed in a circle and distributed regularly;
- the rotational locking means include as many slots as teeth;
- a surface is provided between the slots, this surface being adapted to allow sliding of the teeth against this surface.

Other features and advantages of the invention become apparent in the light of the following description of a preferred embodiment, given by way of nonlimiting example, which description is given with reference to the appended drawings, in which:

FIG. 1 shows the polishing tool 1 ready to be mounted on the rotary spindle of a polishing machine.

The type of polishing machine for which the tool 1 is intended is adapted to impart a rotational movement to a tool mounted on its spindle at the same time as exerting a force for pressing the tool, while rotating, against the surface of the ophthalmic lens to be polished. This pressing force is generally exerted by a pressure agent such as compressed air.

Figure 1:
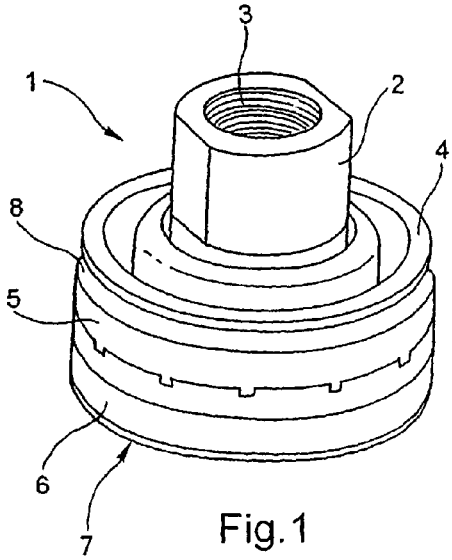
FIG. 1 is a perspective view of a polishing tool according to the invention.
Figure 2:
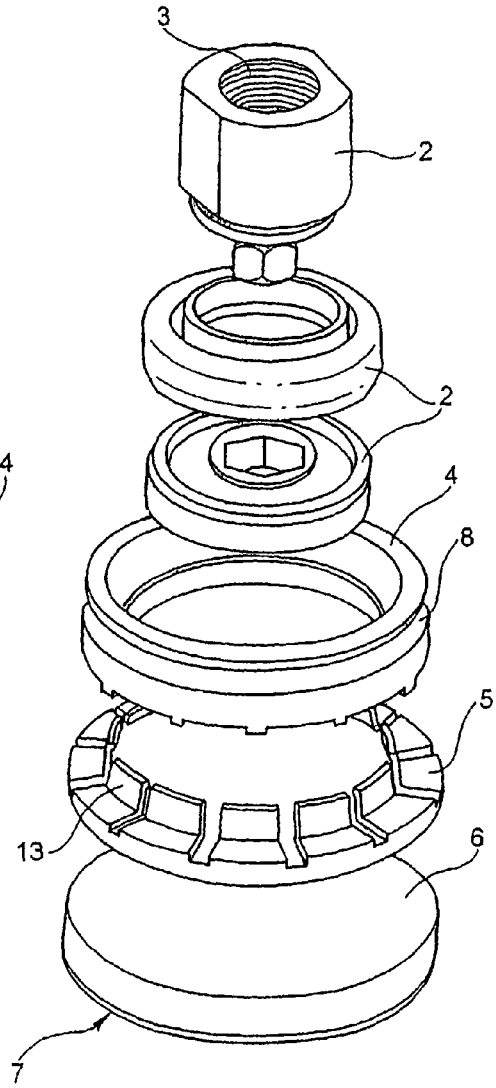
FIG. 2 is an exploded view of the polishing tool from FIG. 1.

The exploded view of FIG. 2 enables the component parts of the polishing tool 1 to be distinguished.

The tool 1 in fact includes a ball-joint 2 including a threaded bore 3 for mounting it on the spindle of the polishing machine. A drive plate 4 is fixed to the ball-joint 2 and a polishing pad 5 is attached to the drive plate 4. A polishing buffer 6 is moreover fixed to the polishing pad 5.

The polishing buffer has an abrasive surface 7 carrying out the polishing operation as such on coming into contact with the surface of the lens to be polished.

Figure 3:
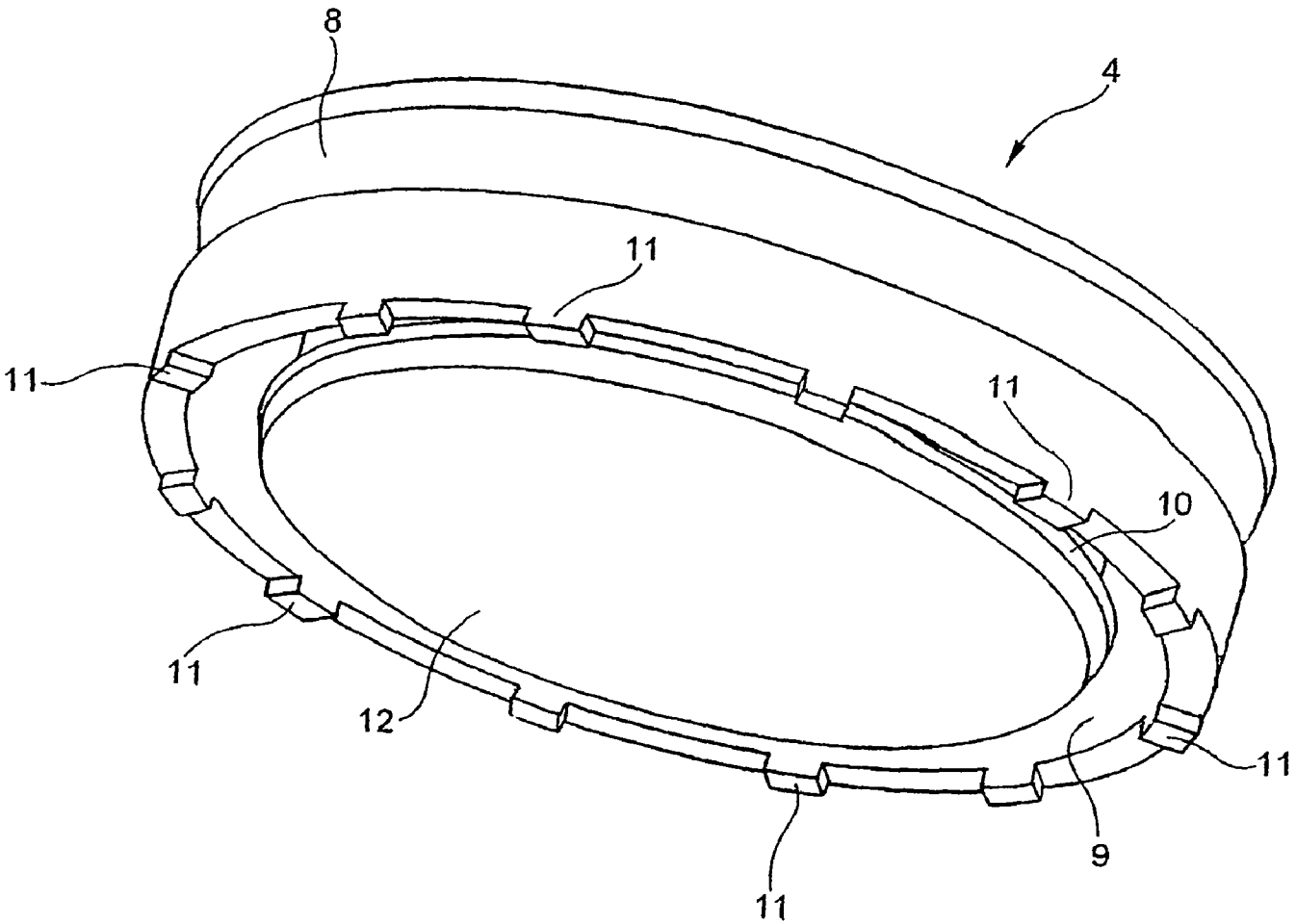
FIG. 3 is a perspective view of the drive plate of the polishing tool from FIGS. 1 and 2.

FIG. 3 shows the drive plate 4 in perspective, as seen from below with respect to its position in FIG. 2.

The drive plate 4 takes the form of a cylinder which has a groove 8 on its perimeter. The drive plate 4 also includes, on its face visible in FIG. 3 (i.e. on its face that faces away from the ball-joint 2) a circular groove 9 extending in the same direction as the cylinder forming the drive plate 4. The interior edges of this groove 9 include a flange 10 projecting transversely with respect to the groove 9 at the level of the surface of the drive plate 4.

Six teeth 11 of rectangular section are moreover disposed on the perimeter of this surface of the drive plate 4.

The circular groove 9 delimits a central abutment 12 flush with, at the same level as, the teeth 11.

Figure 4:
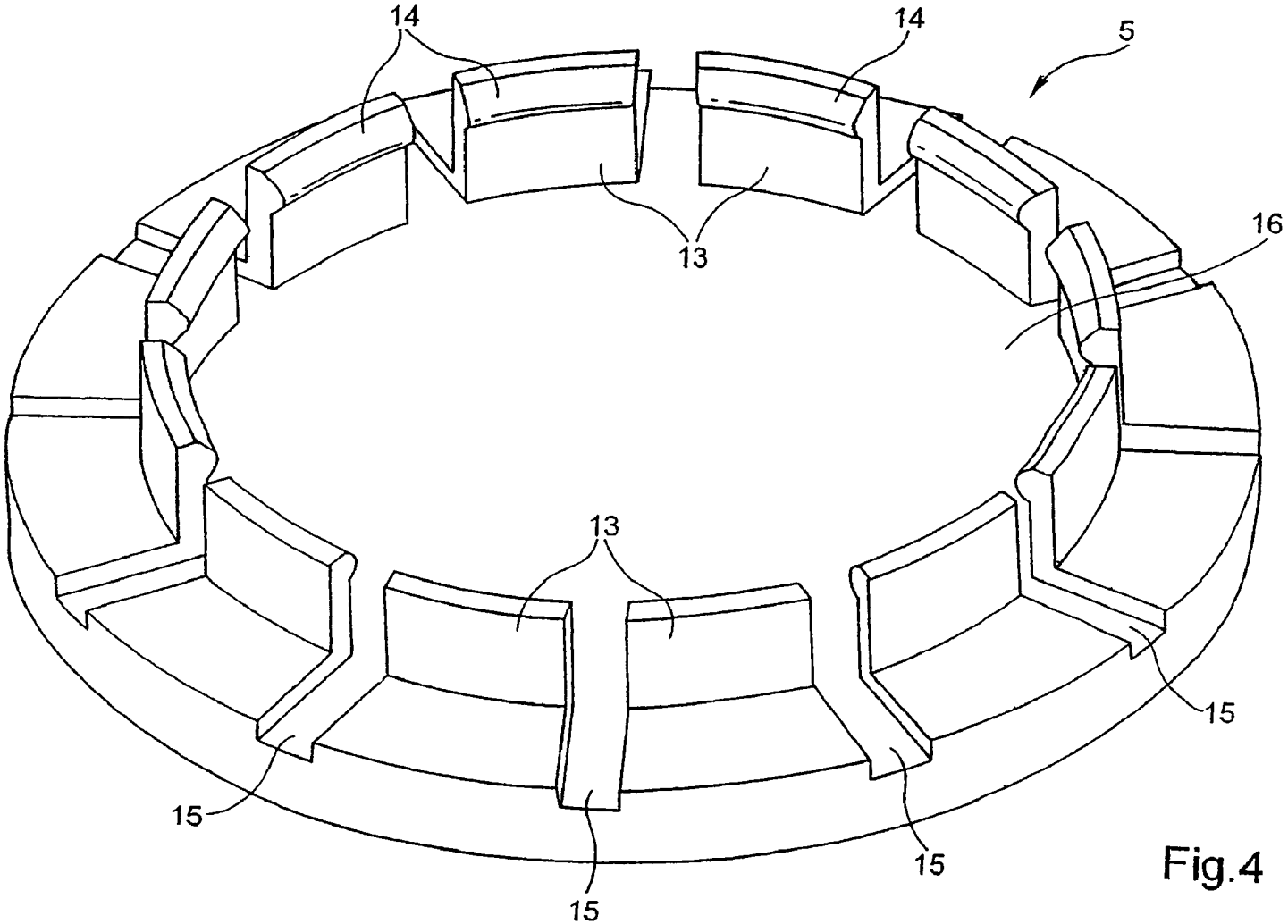
FIG. 4 is a perspective view of the polishing pad of the tool from FIGS. 1 and 2.

FIG. 4 shows in perspective the polishing pad 5 intended to cooperate with the drive plate 4, the polishing pad 5 being in the position that is its position in FIG. 2.

The polishing pad 5 is a rigid disk including elastically deformable and transversely projecting fixing lugs 13 disposed over the whole of the perimeter of the pad 5 to define a cylinder adapted to engage in the circular groove 9 of the drive plate 4. Each of the fixing lugs 13 include an inwardly facing boss 14.

The polishing pad 5 also includes slots 15 disposed over the whole of the circumference of the pad 5, externally of the cylinder formed by the fixing lugs 13. These slots 15 are adapted to engage the teeth 11 of the drive plate 4 and have a depth at least equal to the height of the teeth 11.

Moreover, the surface 16 situated inside the cylinder defined by the fixing lugs 13 is at the same level as the bottom surface of the slots 15.

Figure 5:
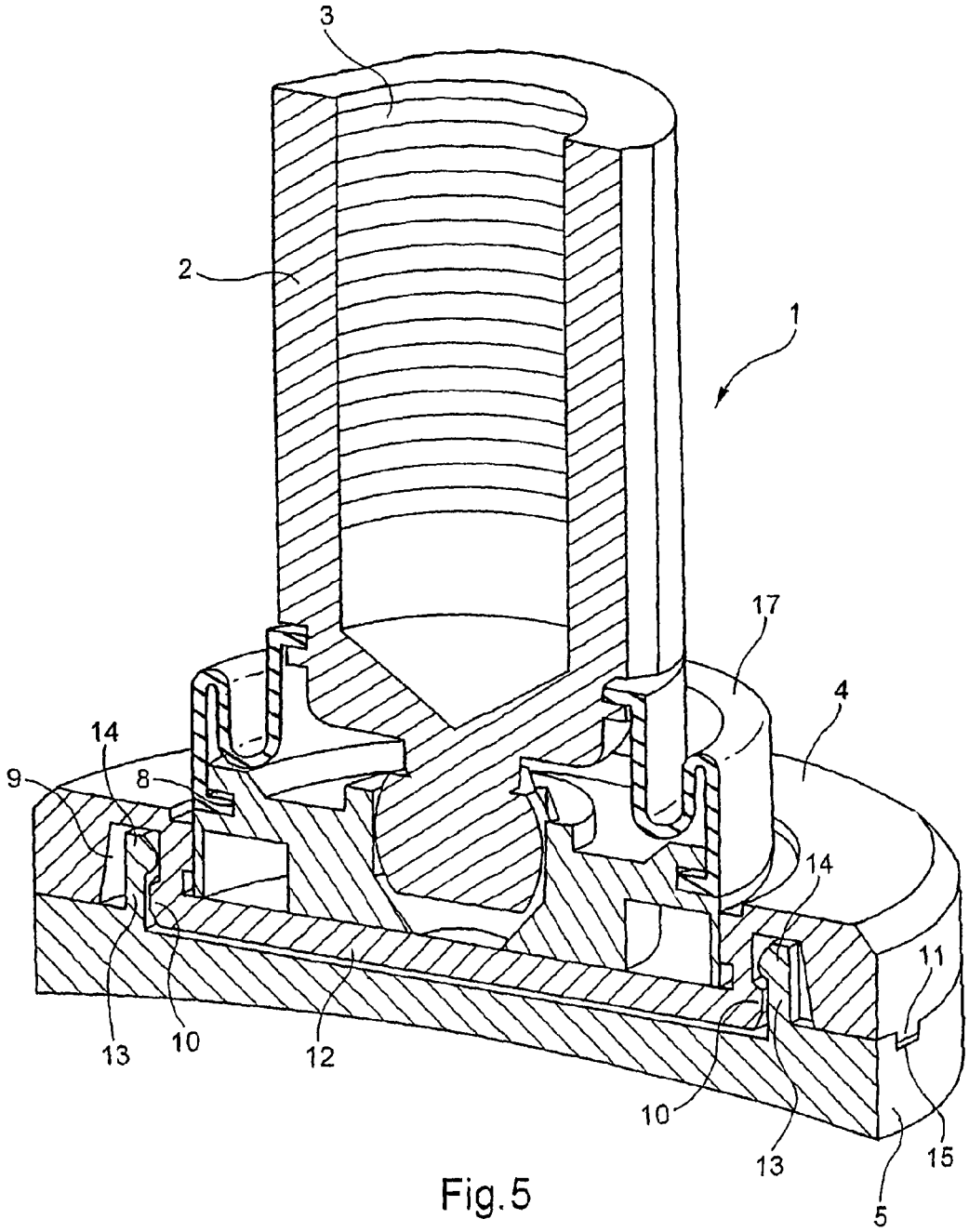
FIG. 5 is a perspective view of the polishing tool from FIG. 1 in diametral section.
Figure 6:
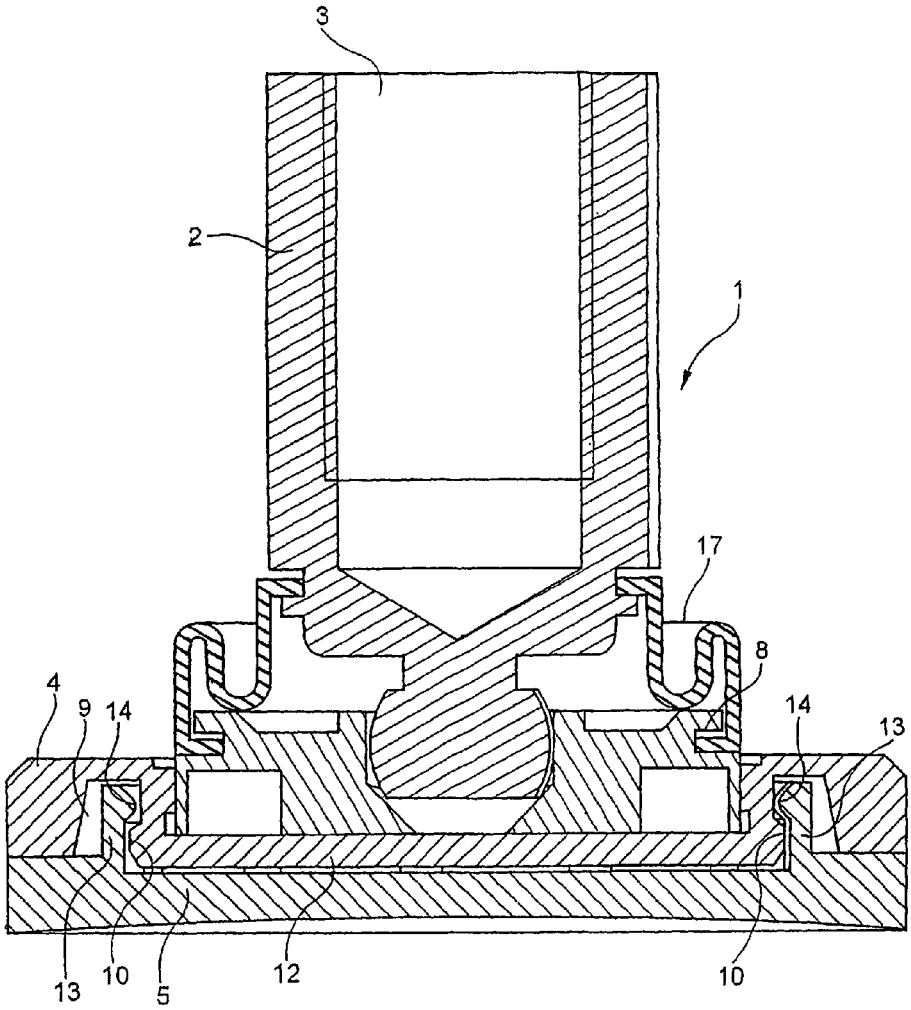
FIG. 6 is a front view of the section from FIG. 5.

The FIGS. 5 and 6 sections show the cooperation of the ball-joint 2, the drive plate 4 and the polishing pad 5.

Thus the drive plate 4 is fixed to the ball-joint 2 by any known means, the ball-joint 2 receiving a circular seal 17 engaging in the groove 8 of the drive plate 4.

The fixing lugs 13 of the polishing pad 5 engage in the circular groove 9 of the drive plate 4 so that the plate 4 is immobilized radially with respect to the pad 5 but is able to slide axially the length of a sliding range that is limited by the bosses 14 abutting against the flange 10.

The polishing tool 1 is employed in the following manner.

The drive plate 4 and its ball-joint 2 are first mounted on the spindle of the polishing machine. These components are intended to remain permanently on the spindle of the machine, only the polishing pad 5 having to be changed to replace a worn out polishing buffer 6 or to change the polishing characteristics.

The polishing pad 5 then engages in the drive plate 4 so that the fixing lugs 13 are deformed so that the bosses can penetrate into the groove 9, pushing past the flange 10, regardless of the relative position of the teeth 11 and the slots 15. The intervention of the user is limited to this engagement.

The polishing pad 5, although retained in the groove 9, cannot be driven in rotation at this stage.

The polishing tool 1 is then positioned against the surface of the ophthalmic lens to be machined and the rotation of the spindle is activated simultaneously or afterwards.

The teeth 11 then slide over the pad 5 until they engage automatically in the slots 15.

The driving of the pad 5 in rotation is started and the polishing operation continues in the conventional way.

Variants of this tool may be envisaged without departing from the scope of the invention. In particular, the polishing pad 5 may be used directly, with no polishing buffer, then having an abrasive surface itself. Moreover, the teeth 11 and the slots 15 may have a shape different from that described here, it being sufficient that their mutual interengagement be possible. The position of the teeth 11 and the slots 15 may moreover be interchanged so that the teeth 11 are attached to the pad 5 and the slots 15 are formed on the plate 4. The same applies to the groove 9 and the lugs 13.

The invention claimed is:

1. A polishing tool (1) for finishing an ophthalmic lens, comprising:

a drive plate (4) equipped with means (2) for mounting the drive plate on a spindle of a polishing machine;

a removable polishing pad (5) adapted to be driven in rotation by the drive plate (4);

wherein the drive plate and polishing pad include positioning means (9, 13) for radially immobilizing said pad (5) with respect to said plate (4) and enabling axial sliding of the pad (5) with respect to the plate (4);

the drive plate and polishing pad including retaining means (10, 14) limiting the axial sliding of the pad (5) with respect to the plate (4) to a pre-determined sliding range; and the drive plate and polishing pad further including rotational locking means, including at least one tooth (11) adapted to engage in a slot of corresponding shape, the tooth (11) and the slot (15) being disposed one on the plate (4) and the other on the pad (5), wherein on engagement of the polishing pad in the retaining means the tooth engages the slot only when pressure is applied between the drive plate and polishing pad to rotationally lock polishing pad with drive plate.

2. The polishing tool according to claim 1, wherein the positioning means include a groove (9) in which an elastic fixing lug (13) engages, the groove (9) and the elastic fixing lug (13) being disposed one on the plate (4) and the other on the pad (5).

3. The polishing tool according to claim 2, wherein the groove (9) is circular and in that a plurality of elastic fixing lugs (13) are disposed in a circle so as to define a cylinder adapted to engage in the groove (9).

4. The polishing tool according to claim 2, wherein the retaining means include a flange (10) disposed in the groove (9) and a boss (14) disposed on the elastic fixing lug (13).

5. The polishing tool according to claim 1, wherein the rotational locking means include a plurality of slots (15) disposed in a circle and distributed regularly.

6. The polishing tool according to claim 1, wherein the rotational locking means include a plurality of teeth (11) disposed in a circle and distributed regularly.

7. The polishing tool according to claim 1, wherein the rotational locking means include as many slots (15) as teeth (11).

8. The polishing tool according to claim 5, wherein a surface is provided between the slots (15), this surface being adapted to allow sliding of the teeth (11) against this surface.

9. The polishing tool according to claim 3, wherein the retaining means include a flange (10) disposed in the groove (9) and a boss (14) disposed on the elastic fixing lug (13).

10. The polishing tool according to claim 2, wherein the rotational locking means include a plurality of slots (15) disposed in a circle and distributed regularly.

11. The polishing tool according to claim 3, wherein the rotational locking means include a plurality of slots (15) disposed in a circle and distributed regularly.

12. The polishing tool according to claim 4, wherein the rotational locking means include a plurality of slots (15) disposed in a circle and distributed regularly.

13. The polishing tool according to claim 2, wherein the rotational locking means include a plurality of teeth (11) disposed in a circle and distributed regularly.

14. The polishing tool according to claim 3, wherein the rotational locking means include a plurality of teeth (11) disposed in a circle and distributed regularly.

15. The polishing tool according to claim 4, wherein the rotational locking means include a plurality of teeth (11) disposed in a circle and distributed regularly.

16. The polishing tool according to claim 5, wherein the rotational locking means include a plurality of teeth (11) disposed in a circle and distributed regularly.

17. The polishing tool according to claim 2, wherein the rotational locking means include as many slots (15) as teeth (11).

18. The polishing tool according to claim 3, wherein the rotational locking means include as many slots (15) as teeth (11).

19. The polishing tool according to claim 6, wherein a surface is provided between the slots (15), this surface being adapted to allow sliding of the teeth (11) against this surface.

20. The polishing tool according to claim 7, wherein a surface is provided between the slots (15), this surface being adapted to allow sliding of the teeth (11) against this surface.

* * * * *